United States Patent [19]

Wells et al.

[11] 4,341,064

[45] Jul. 27, 1982

[54] CABLE MAKING APPARATUS

[75] Inventors: Jasper D. Wells; Robert M. Gilbert, both of Graham, Tex.

[73] Assignee: Electric Hose & Rubber Company, Ocala, Fla.

[21] Appl. No.: 183,015

[22] Filed: Sep. 2, 1980

[51] Int. Cl.[3] ..... D07B 3/06; D04C 3/40; D04C 1/12

[52] U.S. Cl. ..... 57/13; 57/15; 87/29

[58] Field of Search ..... 57/13–15, 57/3, 6, 19; 87/8, 29, 33, 34

[56] References Cited

U.S. PATENT DOCUMENTS

| | | | |
|---|---|---|---|
| 2,802,328 | 8/1957 | Ritchie | 57/13 |
| 3,392,933 | 7/1968 | Singh | 57/13 X |
| 3,651,629 | 3/1972 | Webster | 57/13 |
| 3,886,720 | 6/1975 | Ostermann | 57/13 |

*Primary Examiner*—John Petrakes
*Attorney, Agent, or Firm*—Joseph V. Tassone

[57] ABSTRACT

What is disclosed is an improvement in a braiding assembly having a structural framework and a main rotating braider deck carrying a plurality of bobbins, each having a plurality of spools from which cable is pulled at the desired tension for being braided into a master cable for being wound into respective layers in the hose or the like. The improvement comprises respective bushings and nuts non-rotatably supported on the shafts of the bobbins, the bushings have respective radially protruding bases, or flanges, against which the nuts can tighten respective pairs of adjustably loadable bearings for providing the requisite accurate rotation and adjustable tension for the respective cables.

4 Claims, 3 Drawing Figures

CABLE MAKING APPARATUS

FIELD OF THE INVENTION

This invention relates to braider assemblies for braiding cables, wires, or the like into respective main cables for preparing respective layers on hoses, electric cables, or the like. The embodiment of this invention disclosed herein to an improved bobbin for a braider assembly for braiding smaller cable into respective larger cable for being wound into layers for high strength, high pressure hoses.

DESCRIPTION OF THE PRIOR ART

The prior art has seen a variety of methods and apparatuses for braiding wires, cables and the like. One of the recent innovations that has been made for braiding smaller cable into larger cable for being wound into layers on high pressure hose or the like has been a braiding assembly employing a large rotary braider deck having a plurality of respective bobbins thereon, each of the bobbins having a shaft supporting a plurality of respective spools for the smaller cable. Since the respective cable drums require individual tensioning to have the desired tension on the respective cables, brakes were employed on these drums. These brakes were difficultly maintainable devices that tended to get hot, wear and require more or less continuous servicing to maintain the correct tension for the cable on the respective spools. Accordingly, a solution was sought to this problem. Conventional braking technology having individual operators available was not a feasible solution to solve the problem. Moreover, the respective spools had to rotate accurately and rotation on the shaft with the brake assembly did not achieve the desired result.

SUMMARY OF THE INVENTION

Accordingly, it is an object of this invention to provide an improvement in a braiding assembly in which the respective bobbins enable the respective cable spools to turn accurately and with the desired amount of tension for the respective cables.

It is a specific object of this invention to provide an improvement in a braider assembly in which the respective bobbins provide an individually adjustable bearing and tensioning means to enable the respective spools to rotate accurately, smoothly and with the desired amount of tension, and provide means for adjusting the tension if more or less tension on the cable was required.

These and other objects will become apparent from the descriptive matter hereinafter, particularly when taken in conjunction with the appended drawings.

DESCRIPTION OF THE PREFERRED EMBODIMENTS

Figure 1:
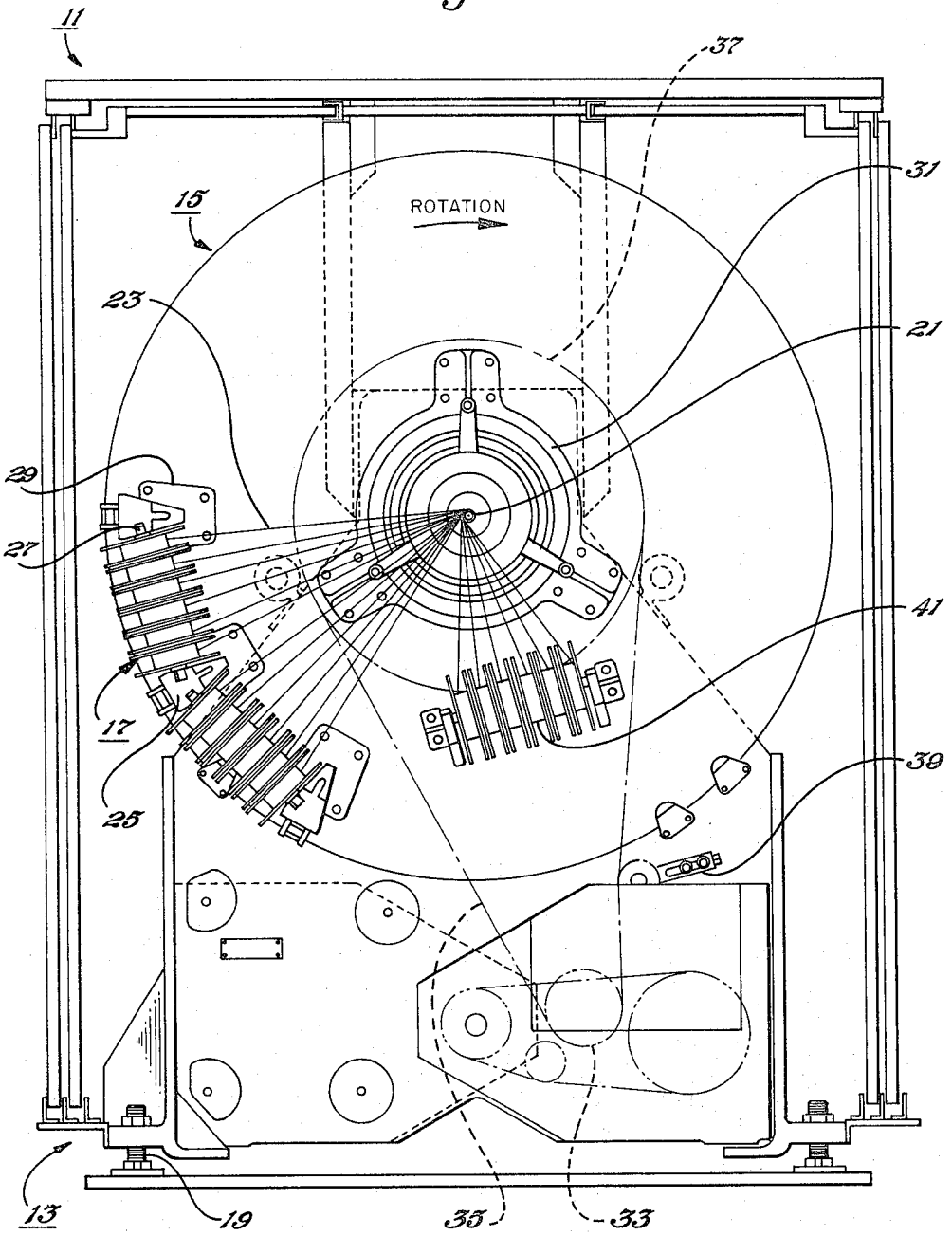
FIG. 1 is an elevational view of a braiding assembly showing the respective rotating table and bobbins thereon.

Referring to FIG. 1, the braiding assembly 11 comprises a structural framework 13, a main rotation means 15 and a plurality of bobbins 17.

The structural framework 13 comprises a series of interconnected members, panels and structural elements in accordance with conventional technology in this art. Ordinarily, the elements of the framework 13 includes respective beams, fillets, panels and other structural members for supporting the main rotation means and having adjustable legs 19 for adjusting height to achieve leveling and the like.

Interwoven into the structural framework is a conventional lubrication system having the usual filter and lubrication means for facilitating rotation of the main rotation means. This invention does not alter the conventional structural framework so it need not be described in great detail. It is sufficient to note that it is adequate to journally support the main rotation means 15 for rotation.

The main rotation means 15 is supported on the structural framework 13 for rotation and has a central aperture 21 for passage therethrough of a plurality of cables such as cables 23 for twisting the plurality of cables into a unitary cable strand. This twisting of the cables is loosely referred to as "braiding"; hence, the term braiding assembly 11. The main rotation means 15 is also referred to as a "braider deck" or "rotating table". The braider deck 15 supports a plurality of respective bobbins 17, only three being shown. Each of the respective bobbins are supported on a bobbin stand 25 at each end of respective shafts 27 and, in turn, supported on respective bases 29. The respective bobbin stands 25, shafts 27 and bases 29, as well as the other accoutrements such as the respective central collars 31, are conventional and do not need further descriptions herein. Similarly, the respective rotation powering means; such as, the powered sheave 33, the lineal drive means 35 and the sheave 37 connected with the braider deck 15, need not be described in great detail since they are conventional. Similarly, in accordance with conventional technology an idler pulley 39 is employed to provide the desired degree of tension in the lineal drive member 35; for example, a plurality of belts. Of course, if desired, respective sprockets and mating chains, other types of transmissions or meshing gears and pinions can be employed to effect rotation of the braider deck 15. This rotation effects movement of the respective bobbins 17 about the central aperture so the respective individual cables are twisted together into a unitary cable for whatever purpose it is desired; for example, it may be wound onto a respective layer of rubber to form one or more respective layers of rubber and cable and ultimately form a high pressure hose or the like.

The bobbins 17 comprise a plurality of spools 41 onto which are wound respective cables. The cables may be of the same or different sizes as desired. The respective spools 41 are supported on the respective shafts 27 for rotation for pulling the cables from the respective spools. The spools of cable are conventional and need not be described in further detail herein.

The improvement of this invention, however, comprises a plurality of respective individual bearing and tensioning means for providing accurate rotation of the spools and for providing adjustable tensioning on the respective spools so that the respective cables are fed at the desired degree of tension. Specifically, the respective bearing and tensioning means in accordance with this invention comprise a plurality of respective bushings 43, FIG. 2, and nuts 45 in combination with the a respective plurality of adjustably loadable bearings 47.

Figure 2:
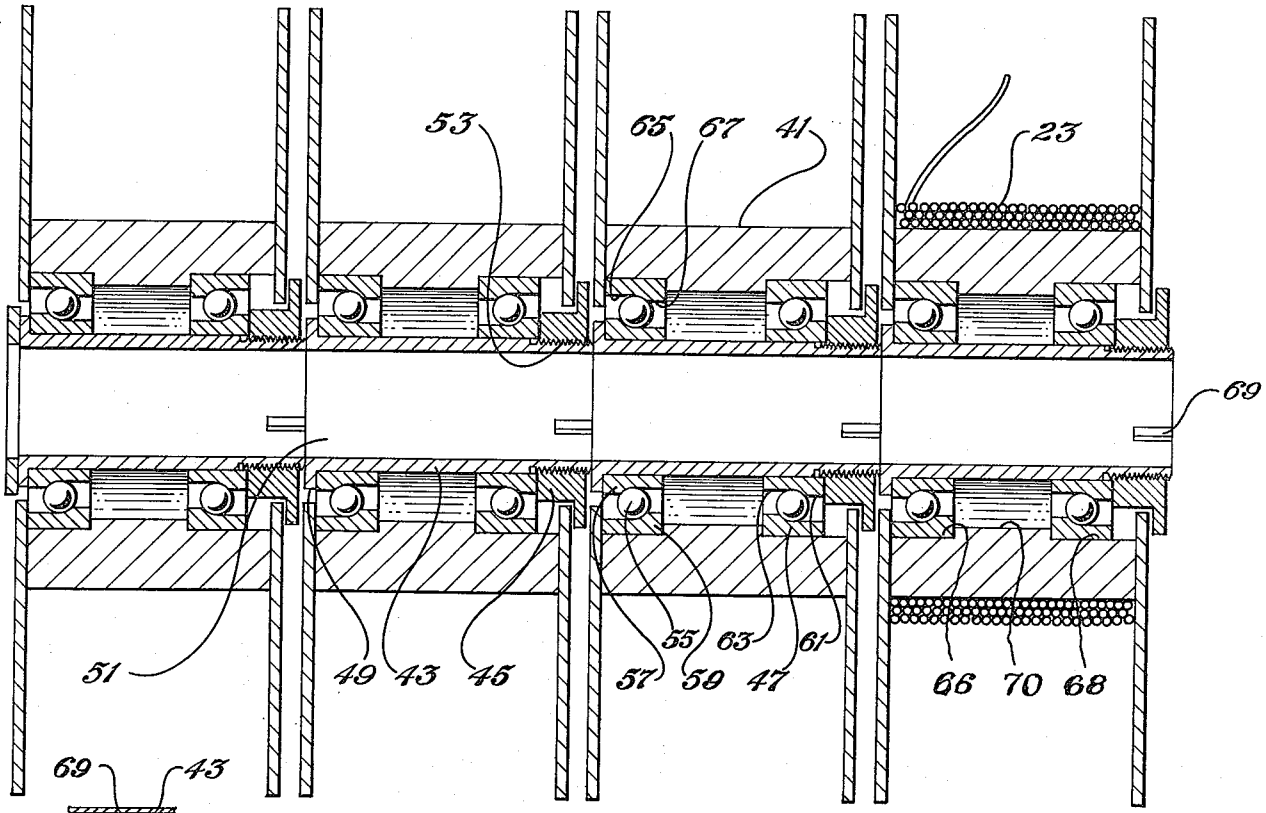
FIG. 2 is a cross sectional view of respective aligned spools of a bobbin with the shaft removed for simplicity of illustration.

Each of the bushings has a respective radially outwardly protruding base, or flange, 49 at a first end 51. Each bushing has a threaded second end 53 that threadedly engages the nut 45. The respective bushings 43 are made of a structurally strong material, such as a metal like steel, such that the respective bearings can be compressively held intermediate the respective bases and nuts 49, 45 with adequate tension to provide the loading. In FIG. 2, it is understood that the respective spools 41 have cable wound thereon although the cable 23 is shown only on one spool.

The respective bearings 47 are angular contact, loadable bearings having ball bearings 55 intermediate respective races 57, 59. As can be seen, the respective interior races 57 have a raised portion 61 of a larger outside diameter than an interior portion 63. Similarly, the radially outer race has respective outer portions 65 of radially larger diameter than a radially inwardly raised portion 67. In this way, the ball bearings can be compressed between the respective raised portions. When the bearings are properly paired thrust can be emplaced on the respective interior races by, the respective nuts 45 and bases 49 on the respective bushings 43. Expressed otherwise, the respective nuts and bases 45, 49, have a diameter less than the diameter of the outer race 58 but large enough to bear on the inner race 57 and provide thrust sufficient to load the bearings with a predetermined force sufficient to effect the desired tension on the respective cables 23 on the respective spools 41. With each spool, the radially outer races 59 of the bearings 41 are ensconsed in respective annular recesses 66 and 68 and frictionally bear against a boss 70 of the spool 41.

Preferably, the bearings are formed of high structural strength material such as the metals like steel.

Figure 3:
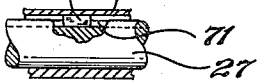
FIG. 3 is a partial side elevational view, partly cut away and partly in section, showing a respective key of one of the bushings emplaced in a slot on the shaft to prevent rotation of the bushing.

As illustrated, the interior of the bushings are shown with the respective keys 69 shown with the shaft removed. The shaft 27 has a keyway slot along its longitudinal length. The respective keys 69 slide downwardly along the keyway slot to prevent the bushings from rotating with respect to the shaft. Accordingly, the thrust force on the respective bearings 47 determines the resistance to rotation of the respective spools 41 and hence the tension in the cables 23. A particular arrangement can be seen in FIG. 3 wherein the shaft 27 has the keyway slot 71 into which is fitted the key 69 of the bushing 43.

In a typical operation, the respective cable spools 41 having the cables 23 wound thereon are emplaced over the respective bearings 47 held intermediate the respective bases 49 and nuts 45. The nuts are suitably tightened to afford the desired thrust to effect the desired tension in the cables 23. Thereafter, the respective bushings 43 containing respective nuts and bearings with spool and cable are slid onto the respective shafts 27 and held in place by conventional means. The cables are then pulled toward the central aperture 21.

An interior hose layer is then emplaced over a mandrel and the respective braider deck rotated to twist the respective individual cables into a unitary cable that is wound over the inside hose layer emplaced over the mandrel. The unitary cable is wrapped so as to form a continuous layer over the inside hose layer. Ordinarily, an opposite deck is performing the same twisting of the cables, or braiding, into a unitary cable that is rotated in the opposite direction. Between each layer of such cable there will be a layer of raw rubber. For example, there may be up to five braider decks with two sides each to form the desired number of layers of cable and rubber. Finally, a thick hard rubber layer is applied to the exterior of the hose. The rubber may be applied by pressurizing the outer hose to expand it then push it over the combined layers of rubber and cable. Thereafter, it may be wrapped with a nylon rag and vulcanized to form it into a unitary high pressure hose or the like.

From the foregoing, it can be seen that this invention provides the objects delineated hereinbefore. Specifically, it solves the problem of providing accurate rotation by the respective spools on the bearing assemblies while simultaneously providing the desired tension on the cables without having to have respective individual, difficulty maintainable brake assemblies in accordance with the prior art.

Although the invention has been described with a certain degree of particularly, it is understood that the present disclosure is made only by way of example and that numerous changes in the details of construction and the combination and arrangement of parts may be resorted to without departing from the spirit and scope of the invention, reference for the latter being had to the appended claims.

We claim:

1. In a cable braiding assembly including:

a. a structural framework;

b. a main rotation means rotatably supported on said structural framework having a central aperture for passage therethrough of a plurality of cables being braided into a main cable for being wrapped into respective layers in a hose or the like; and c. a plurality of bobbins comprising a plurality of cable spools supported on respective shafts on said main rotation means such that said cables can be pulled therefrom with respective degrees of tension to said central aperture for braiding;

the improvement comprising:

d. bearing and tensioning means for providing accurate rotation and adjustable tension on respective said cable spools such that respective said cables can be unwound from respective said spools at a predetermined tension; said bearing and tensioning means comprising, 1. a plurality of respective bushings and nuts nonrotatably supported by respective said shafts; each said bushing having a radially protruding base at a first end and threadingly engaging a said nut at a second end opposite said first end and adapted to encompass therebetween a plurality of adjustably loadable bearings supporting said spool; and 2. a plurality of adjustably loadable bearings; a pair of said bearings for each said spool; respective said bearings having respective angular contacts so as to adjust the tension in response to adjustment of thrust loaded onto the bearing by respective nuts against respective said radially protruding bases such that respective tensions for the respective cable spools can be adjusted individually by respective said nuts.

2. The braiding assembly of claim 1 wherein a plurality of respective sets of bushings, bearings, spools and nuts are disposed along respective said shafts.

3. The braiding assembly of claim 2 wherein said bearings comprise ball bearings having respective inner and outer races; said inner races frictionally engaging respective said bushings; said outer races frictionally engaging respective said spools; both said races having respective raised portions and adapted to be paired to provide rotational drag in response to longitudinal thrust for providing adjustable tension in said cable being unreeled from respective said spools; said nuts and bases co-acting to provide desired and adjustable longitudinal thrust on respective said bearings.

4. The braiding assembly of claim 3 wherein said bearings have outer races, each having a first inwardly raised race portion that is radially smaller in diameter than a second race portion, have inner races having a third raised race portion that is radially larger in diameter than a fourth race portion such that said bearings can be paired up and said respective third raised race portions emplaced longitudinally exteriorly on respective said bushings such that thrust can be emplaced on inner races by respective said nuts and radially protruding shoulders at the respective ends of said bushings and bear thrust against respective said ball bearings and respective first inwardly raised race portions of said outer races.

* * * * *